US009593833B2

(12) United States Patent
McMannon et al.

(10) Patent No.: US 9,593,833 B2
(45) Date of Patent: Mar. 14, 2017

(54) SEAT ASSEMBLY FOR A PATIENT TRANSPORT DEVICE

(71) Applicant: Ferno-Washington, Inc., Wilmington, OH (US)

(72) Inventors: Bart McMannon, Lebanon, OH (US); Peter Smolán, Trenčin (SK); Timothy Paul Schroeder, Mason, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 14/681,190

(22) Filed: Apr. 8, 2015

(65) Prior Publication Data

US 2015/0285478 A1 Oct. 8, 2015

Related U.S. Application Data

(60) Provisional application No. 61/976,694, filed on Apr. 8, 2014.

(51) Int. Cl.
*F21V 23/04* (2006.01)
*A61G 5/10* (2006.01)
(Continued)

(52) U.S. Cl.
CPC ..... *F21V 23/0464* (2013.01); *A61G 5/061* (2013.01); *A61G 5/066* (2013.01);
(Continued)

(58) Field of Classification Search
CPC .... F21V 23/0464; F21V 33/0068; F21L 4/00; F21W 2131/20; A61G 5/061; A61G 5/066; A61G 5/10; A61G 2203/30
(Continued)

(56) References Cited

U.S. PATENT DOCUMENTS 6,416,272 B1 * 7/2002 Suehiro ..... B60N 2/245 280/643
6,702,314 B1 3/2004 Crose
(Continued)

FOREIGN PATENT DOCUMENTS

WO WO2013025780 A1 2/2013
WO WO2014035250 A1 3/2014

OTHER PUBLICATIONS

International Search Report and Written Opinion relating to International Application No. PCT/US2015/024898 mailed on Jul. 15, 2015.

*Primary Examiner* — Tony Winner
*Assistant Examiner* — Felicia L Brittman
(74) *Attorney, Agent, or Firm* — Dinsmore & Shohl LLP

(57) ABSTRACT

A seat assembly for a patient transport device includes a seat casing including a bottom surface, a rear edge including a rear edge outward-facing surface, where the rear edge extends downward from the bottom surface in a vertical direction, and a lighting unit including a controller including a processor and a memory storing a machine readable and executable instruction set, a sensor communicatively coupled to the controller, and a light output communicatively coupled to the controller, where the light output is coupled to at least one of the bottom surface or the rear edge outward-facing surface of the seat casing, where the light output extends across the seat casing in a lateral direction, and where the light output selectively provides light beneath the seat assembly, where the controller commands the lighting unit to change between an ON position and an OFF position based on a signal from the sensor.

8 Claims, 12 Drawing Sheets

(51) Int. Cl.

| | |
|---|---|
| ***F21V 33/00*** | (2006.01) |
| ***F21L 4/00*** | (2006.01) |
| ***A61G 5/06*** | (2006.01) |
| *F21W 131/20* | (2006.01) |

(52) U.S. Cl.
CPC ..... *A61G 5/10* (2013.01); *F21L 4/00* (2013.01); *F21V 33/0068* (2013.01); *A61G 2203/30* (2013.01); *F21W 2131/20* (2013.01)

(58) Field of Classification Search
USPC ... 5/81.1 R, 84.1, 86.1, 89.1, 625, 626, 627, 5/653, 666, 905; 297/217.1, 217.2, 217.3, 297/217.4, 217.6
See application file for complete search history.

(56) References Cited

U.S. PATENT DOCUMENTS

| | | | | |
|---|---|---|---|---|
| 2007/0095581 | A1 | 5/2007 | Chambliss | |
| 2009/0143943 | A1* | 6/2009 | Jaramillo ..... | B60N 2/002 701/45 |
| 2010/0052381 | A1* | 3/2010 | Tingley ..... | A61G 5/10 297/217.3 |
| 2015/0120340 | A1* | 4/2015 | Cheatham, III ..... | G06Q 10/02 705/5 |

* cited by examiner

SEAT ASSEMBLY FOR A PATIENT TRANSPORT DEVICE

CROSS REFERENCE TO RELATED APPLICATIONS

The present application claims the benefit of and priority to U.S. Provisional Patent Application No. 61/976,694, filed on Apr. 8, 2014 and entitled "Seat Assembly for a Patient Transport Device," the entire disclosure of which is hereby incorporated by reference.

TECHNICAL FIELD

This application relates generally to a seat assembly for a patient transport device and methods of use thereof.

BACKGROUND

Patient transport devices may be used for loading and unloading patients into and out of ambulances or other transport vehicles. In moving patients to the ambulance or other transport vehicle, first responders may be required to transport the patients over various obstacles, including stairs that may include poor and/or minimal lighting. These obstacles present challenges to the first responders and increase the difficulty of transporting the patient to the ambulance or other transport vehicle.

Accordingly, a need exists for alternative patient transport devices, and in particular for alternative seat assemblies for patient transport devices.

SUMMARY

In one embodiment, a seat assembly includes a seat casing including a bottom surface, a rear edge including a rear edge outward-facing surface, where the rear edge extends downward from the bottom surface in a vertical direction, and a lighting unit including a controller including a processor and a memory storing a machine readable and executable instruction set, a sensor communicatively coupled to the controller, and a light output communicatively coupled to the controller, where the light output is coupled to at least one of the bottom surface or the rear edge outward-facing surface of the seat casing, where the light output extends across the seat casing in a lateral direction, and where the light output selectively provides light beneath the seat assembly, where the controller commands the lighting unit to change between an ON position in which the light output is engaged and illuminated and an OFF position in which the light output is disengaged not illuminated based on a signal from the sensor.

In another embodiment, a patient transport device includes a patient transport frame, a seat portion that is repositionable between a collapsed position and an extended position, the seat portion including a seat casing including a bottom surface, a rear edge including a rear edge outward-facing surface, where the rear edge outward-facing surface extends downward from the bottom surface in a vertical direction, a sensor coupled to at least one of the seat casing or the patient transport frame, a light output coupled to at least one of the bottom surface or the rear edge outward-facing surface of the seat casing, where the light output is communicatively coupled and responsive to the sensor, such that the light output changes between an ON position in which the light output is engaged and illuminated and an OFF position in which the light output is disengaged and not illuminated based on a signal from the sensor.

In yet another embodiment, a patient transport device includes a patient transport frame, a track assembly pivotally coupled to the patient transport frame, where the track assembly is repositionable between a deployed position and a stowed position, a user control communicatively coupled to the track assembly, where the user control selectively commands the track assembly to rotate, a battery pack electrically coupled to the track assembly, where the battery pack provides electrical power to the track assembly, and a seat assembly severally coupled to the patient transport frame, the seat assembly including a seat casing including a bottom surface, a rear edge including a rear edge outward-facing surface, where the rear edge extends downward from the bottom surface in a vertical direction, and a lighting unit including a light output that is coupled to at least one of the bottom surface or the rear edge outward-facing surface of the seat casing, where the light output extends across the seat casing in a lateral direction, and where the light output selectively provides light beneath the seat assembly.

These and other features and advantages of the present disclosure will be more fully understood from the following description of the various embodiments of the present disclosure taken together with the accompanying drawings. It is noted that the scope of the claims is defined by the recitations therein, and not by the specific discussion of features and advantages set forth in the present disclosure.

BRIEF DESCRIPTION OF THE DRAWINGS

The embodiments set forth in the drawings are illustrative and exemplary in nature and not intended to limit the subject matter defined by the claims. The following detailed description of the illustrative embodiments may be understood when read in conjunction with the following drawings, where like structure is indicated with like reference numerals and in which:

DETAILED DESCRIPTION

Seat assemblies according to the present disclosure include a lighting unit that includes a light output that is coupled to at least one of a bottom surface of the seat assembly or a rear edge outward-facing surface of the seat assembly. In one embodiment, the lighting unit includes a controller that is communicatively coupled to the light output, where the controller facilitates operation of the lighting unit. In other embodiments, the seat assembly is severally coupled to a patient transport device that includes a track assembly that may assist a first responder in moving the patient transport device up and down stairs. By including a lighting unit that includes a light output that is coupled to at least one of the bottom surface of the seat assembly or the rear edge outward-facing surface of the seat assembly, the lighting unit may provide light beneath a patient transport device, assisting first responders in identifying obstacles while moving patients to and from an emergency service vehicle. These and other embodiments will be described in more detail below in reference to the appended drawings.

Unless otherwise defined, all technical and scientific terms used herein have the same meaning as commonly understood by one of ordinary skill in the art to which embodiments of this disclosure belong. The terminology used herein is for describing particular embodiments only and is not intended to be limiting. As used in the specification and appended claims, the singular forms "a," "an," and "the" are intended to include the plural forms as well, unless the context clearly indicates otherwise.

The phrase "communicatively coupled," is used herein to describe the interconnectivity of various components of the seat assembly and means that the components are connected either through wires, optical fibers, or wirelessly such that electrical, optical, and/or electromagnetic signals may be exchanged between the components. The phrase "electrically coupled" is used herein to describe the interconnectivity of various components of the seat assembly and means that the components are connected through wires or the like, such that electrical current may be exchanged between the components.

Figure 1:
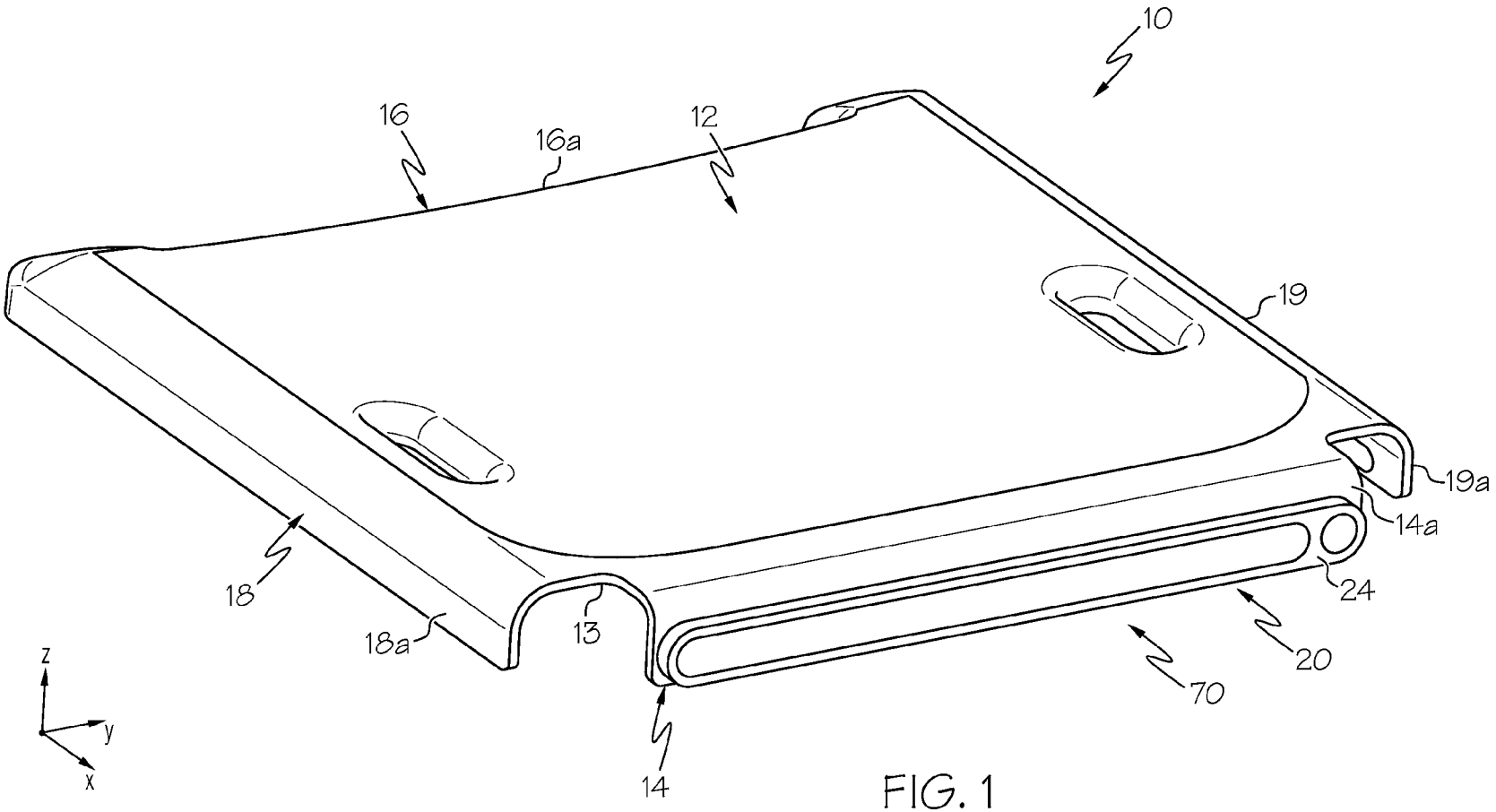
FIG. 1 schematically depicts a rear perspective view of a seat assembly according to one or more embodiments described herein.

Referring to FIG. 1, a perspective view of a seat assembly 10 that may form a seat for a human subject is depicted. The seat assembly 10 may be severally attached to a seat segment of a patient transport device (see, e.g. FIGS. 8-11). The seat assembly 10 includes a seat casing 12 having a bottom surface 13, a rear edge 14, a front edge 16 positioned forward of and opposite of the rear edge 14, and a pair of opposing side edges, for example, a left side edge 18 and a right side edge 19. Each of the rear edge 14, the front edge 16, the left side edge 18, and the right side edge 19 extends downward from the bottom surface 13 of the seat casing 12 in a vertical direction (i.e., in the −Z-direction depicted in FIG. 1).

Each edge of the seat casing 12 includes an outward facing surface. The rear edge 14 includes a rear edge outward-facing surface 14*a*, the front edge 16 includes a front edge outward-facing surface 16*a*, the left side edge 18 includes a left side outward-facing surface 18*a*, and the right side edge 19 includes a right side edge outward-facing surface 19*a*. The seat casing 12 is formed from a polymer-based plastic. Alternatively, the seat casing 12 may be formed from any suitable material, including, but not limited to, polymers, elastomers, metals, fiberglass, composites, or the like. The seat assembly 10 includes a lighting unit 70 that includes a light output. In the embodiment depicted in FIG. 1, the lighting unit 70 includes an illumination panel 20 including a rear light output 22*a*, where the illumination panel 20 is coupled to the rear edge outward-facing surface 14*a*. The illumination panel 20 provides light that may assist first responders in identifying obstacles while transporting a patient, as will be described in greater detail herein.

Figure 2:
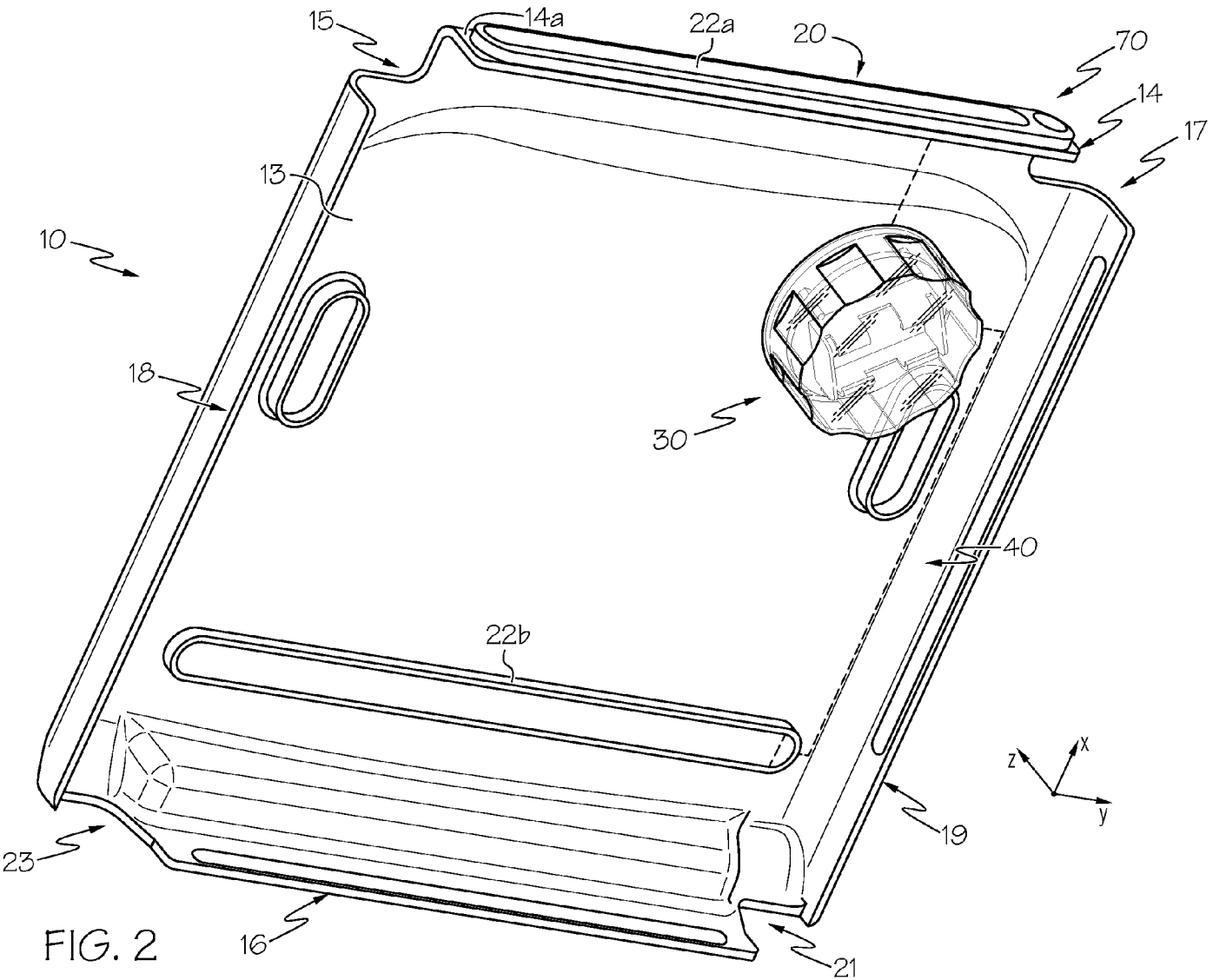
FIG. 2 schematically depicts a perspective view of a bottom of the seat assembly of FIG. 1 according to one or more embodiments described herein.

Referring to FIG. 2, a perspective view of the bottom surface 13 of the seat assembly 10 is depicted. The rear edge 14, the front edge 16, the left side edge 18, and the right side edge 19 of the seat casing 12 facilitate attachment of the seat assembly 10 to a patient transport device (see, e.g. FIGS. 8-11). In particular, the rear edge 14, the right side edge 19, the front edge 16, and the left side edge 18 define a plurality of openings that facilitate attachment of the seat assembly 10 to a patient transport device, in which ones of the plurality of openings are positioned between adjacent edges. The rear edge 14 and the right side edge 19 define a right rear opening 17 that is positioned between the rear edge 14 and the right side edge 19. The right side edge 19 and the front edge 16 define a right front opening 21 that is positioned between the right side edge 19 and the front edge 16. The front edge 16 and the left side edge 18 define a left front opening 23 that is positioned between the front edge 16 and the left side edge 18. The left side edge 18 and the rear edge 14 define a left rear opening 15 that is positioned between the left side edge 18 and the rear edge 14. The right rear opening 17, the right front opening 21, the left front opening 23, and the left rear opening 15 may accommodate a frame of a patient transport device to severally attach the seat assembly 10 to the patient transport device.

The seat assembly 10 includes the illumination panel 20 attached to the rear edge outward-facing surface 14*a* of the seat casing 12. The illumination panel 20 includes the rear light output 22*a* that is coupled to the rear edge 14 of the seat casing 12. The rear light output 22*a* may be integral with and/or attached to the illumination panel 20. The seat assembly 10 may further include a lower light output 22*b* that is coupled to the bottom surface 13 of the seat assembly 10. The lower light output 22*b* is coupled to and may be removable from the bottom surface 13 of the seat casing 12. As depicted, the lower light output 22*b* extends in a lateral direction (i.e., in the +/−Y-direction depicted in FIG. 2) along the bottom surface 13 between the right side edge 19 and the left side edge 18. The rear light output 22*a* extends in the lateral direction across the rear edge 14 between the right rear opening 17 and the left rear opening 15. The rear light output 22*a* and the lower light output 22*b* may include any number of different illumination devices, including but not limited to a light emitting diode (LED), fluorescent lamps, incandescent light bulbs, or any suitable light source. The rear light output 22*a* and the lower light output 22*b* selectively provide light beneath the seat assembly 10 to assist a first responder in manipulating a patient transport device over an obstacle.

Figure 3:
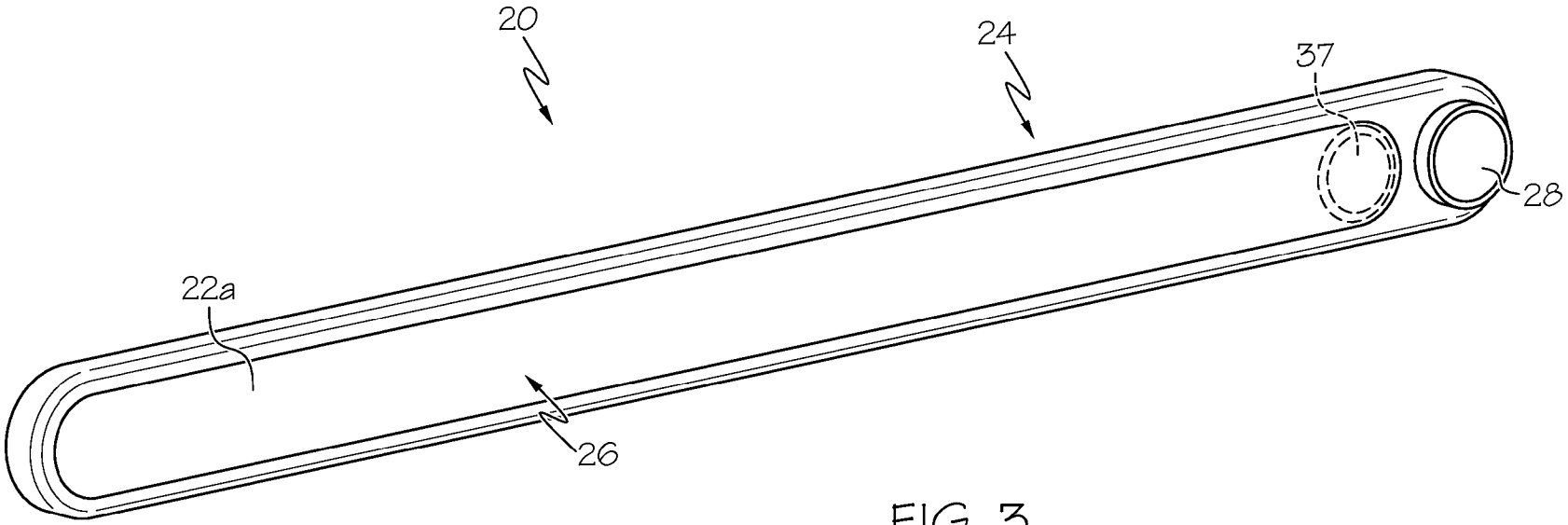
FIG. 3 schematically depicts a perspective view of a front of an illumination panel of the seat assembly of FIG. 1 according to one or more embodiments described herein.
Figure 4:
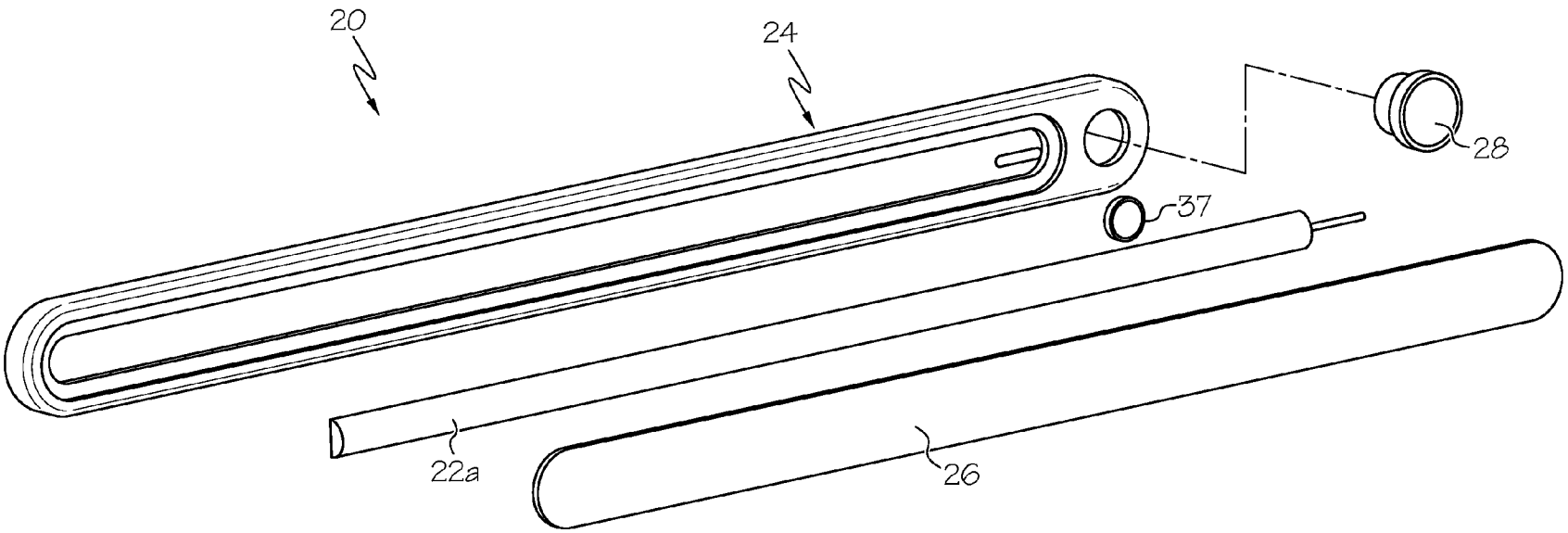
FIG. 4 schematically depicts an exploded perspective view of the illumination panel of FIG. 3 according to one or more embodiments described herein.

Referring to FIGS. 3 and 4 collectively, the illumination panel 20 includes a base 24 that is coupled to the rear edge outward-facing surface 14*a* (FIG. 1). The base 24 is formed from a polymer-based plastic. Alternatively, the base 24 may be formed from any suitable material, including, but not limited to, polymers, elastomers, metals, fiberglass, composites, or the like. The rear light output 22*a* is attached to and may be removable from the base 24. A cover 26 is positioned over and at least partially encloses the rear light output 22*a*, and the cover 26 is attached to and may be removable from the base 24. The cover 26 is formed from a transparent and/or translucent material such as glass, plastic, or the like, such that the rear light output 22*a* illuminates therethrough.

The illumination panel 20 includes an operating element that may selectively engage or disengage the rear light output 22*a* and/or the lower light output 22*b* (FIG. 2). In the embodiment depicted in FIGS. 3 and 4, the illumination panel 20 includes a manual input 28 mounted onto the base 24. The manual input 28 includes a spring-biased user activated pushbutton. Alternatively, the manual input 28 may include any suitable manual input device, including, but not limited to, a proximity sensor, a capacitive touch sensor, or the like.

Alternatively or additionally, the lighting unit 70 includes an activation sensor. In embodiments, the illumination panel 20 may include an illumination panel activation sensor 37 coupled to the base 24 that selectively engages or disengages the rear light output 22*a* and/or the lower light output 22*b* (FIG. 2). The illumination panel activation sensor 37 detects the amount of ambient light surrounding the seat assembly 10 and may include a photodetector such as, for example, a charge coupled device, a light dependent resistor, a photo transistor, a photodiode, or the like. The illumination panel activation sensor 37 may be communicatively coupled to one or more controllers 90 (FIG. 12) that perform functions when the illumination panel activation sensor 37 detects a level of lighting that is above or below a predetermined threshold. For example, when the illumination panel activation sensor 37 is exposed to a level of light above a predetermined threshold, the rear light output 22*a* and the lower light output 22*b* can be automatically disengaged, as will be described in greater detail herein.

Figure 5:
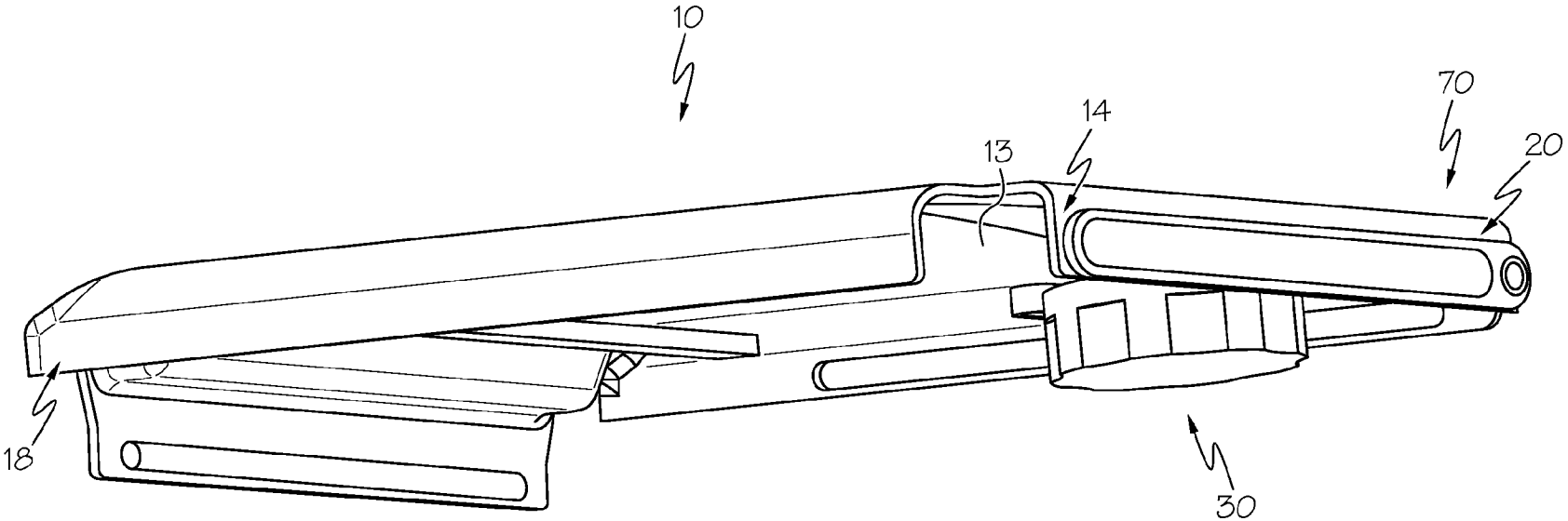
FIG. 5 schematically depicts a perspective view of the bottom of the seat assembly of FIG. 1 according to one or more embodiments described herein.

Referring to FIG. 5, the seat assembly 10 includes a housing 30 that is coupled to the bottom surface 13 of the seat casing 12. In the embodiment depicted in FIG. 5, the housing 30 is positioned adjacent the rear edge 14 and the right side edge 19. Alternatively, the housing 30 may be coupled to the bottom surface 13 of the seat casing at any suitable location.

Figure 6:
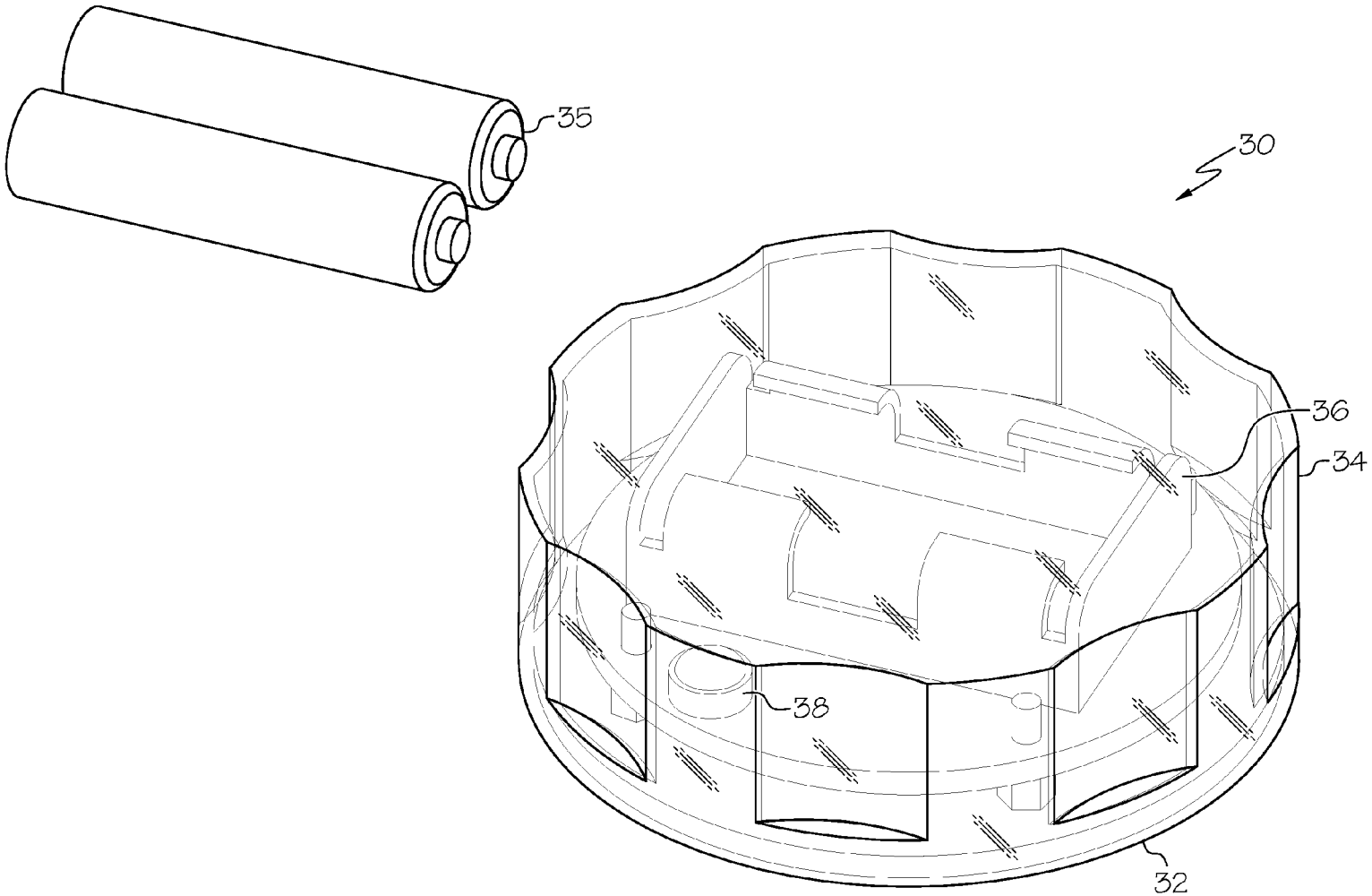
FIG. 6 schematically depicts an enlarged perspective view of the housing of FIG. 5 according to one or more embodiments described herein.
Figure 7:
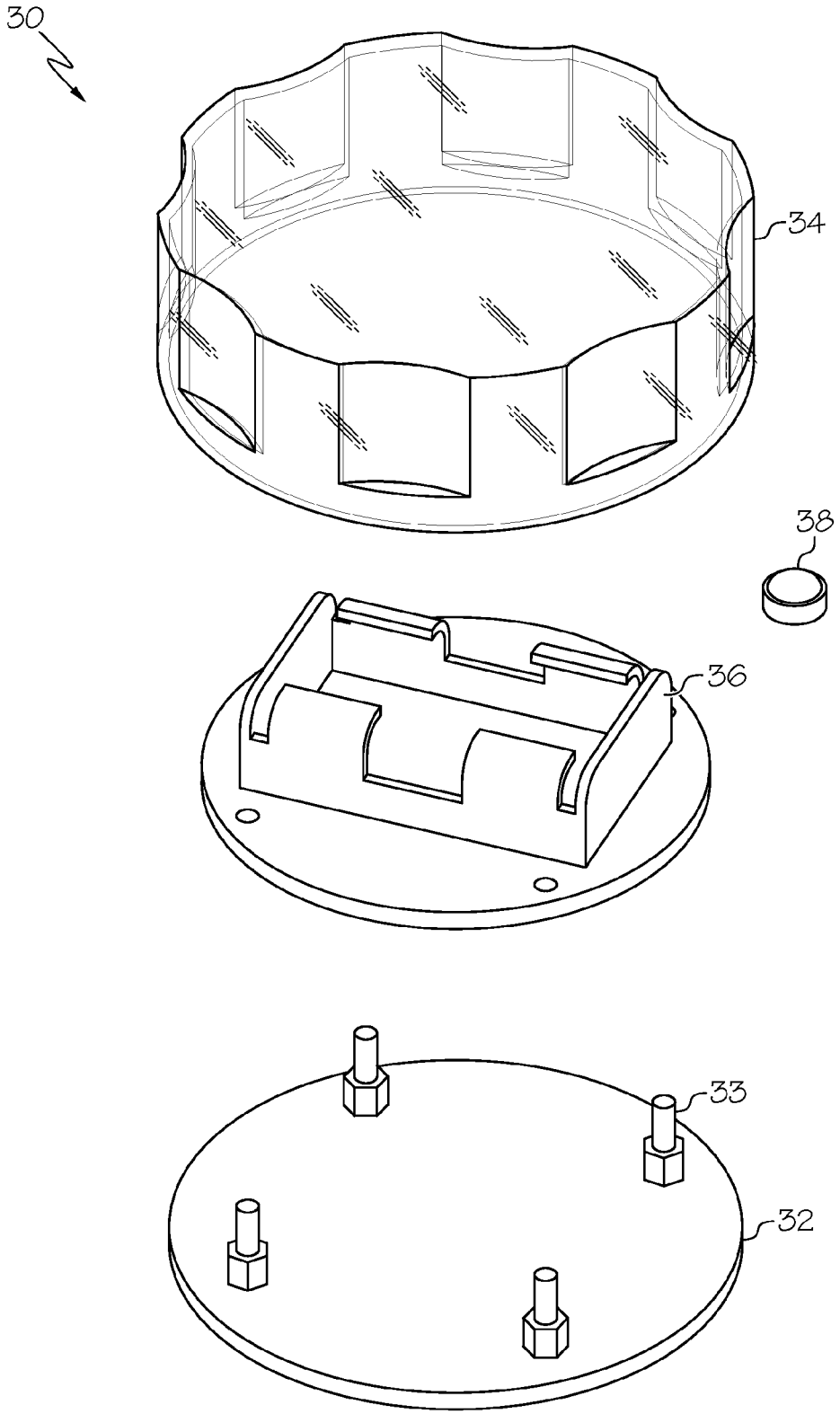
FIG. 7 schematically depicts an exploded perspective view of the housing of FIG. 6 according to one or more embodiments described herein.

Referring to FIGS. 6 and 7 collectively, the housing 30 includes a platform 32 mounted onto and removable from the bottom surface 13 (FIG. 5) of the seat casing 12, a battery holder 36 mounted to the platform 32, and a shell 34 that at least partially encloses the battery holder 36 and that is attached to and removable from the platform 32. The battery holder 36 holds one or more batteries 35 which provide power to the seat assembly 10. In particular, the batteries 35 are electrically coupled to the rear light output 22*a* and/or the lower light output 22*b* and may provide power to the rear light output 22*a* and/or the lower light output 22*b* through wires that may be routed along a wiring route 40 (FIG. 2).

The shell 34 may be made of a transparent and/or translucent material such that light may pass through the shell 34 to reach a housing activation sensor 38 that is coupled to and/or positioned within the housing 30. The seat assembly 10 may include the housing activation sensor 38 in addition to or as an alternative to the illumination panel activation sensor 37 (FIG. 4). The housing activation sensor 38 detects the amount of ambient light surrounding the seat assembly 10 and may include a photodetector such as, for example, a charge coupled device, a light dependent resistor, a photo transistor, a photodiode, or the like. The housing activation sensor 38 may be communicatively coupled to one or more controllers 90 (FIG. 12) that perform functions when the housing activation sensor 38 detects a level of lighting that is above or below a predetermined threshold. For example, when housing activation sensor 38 is exposed to a level of light above a predetermined threshold, the rear light output 22*a* and the lower light output 22*b* can be automatically disengaged, as will be described in greater detail herein.

Referring to FIG. 7, the battery holder 36 is mounted to the platform 32 by bolts 33 that are attached to the platform 32. Alternatively, the battery holder 36 may be mounted to the platform 32 by any suitable attachment method, for example and without limitation, mechanical fasteners, adhesives, or the like. The shell 34 may be attached to the platform 32 via screw threads (not shown), or by any suitable attachment method, for example and without limitation, mechanical fasteners, adhesives, or the like.

Figure 8:
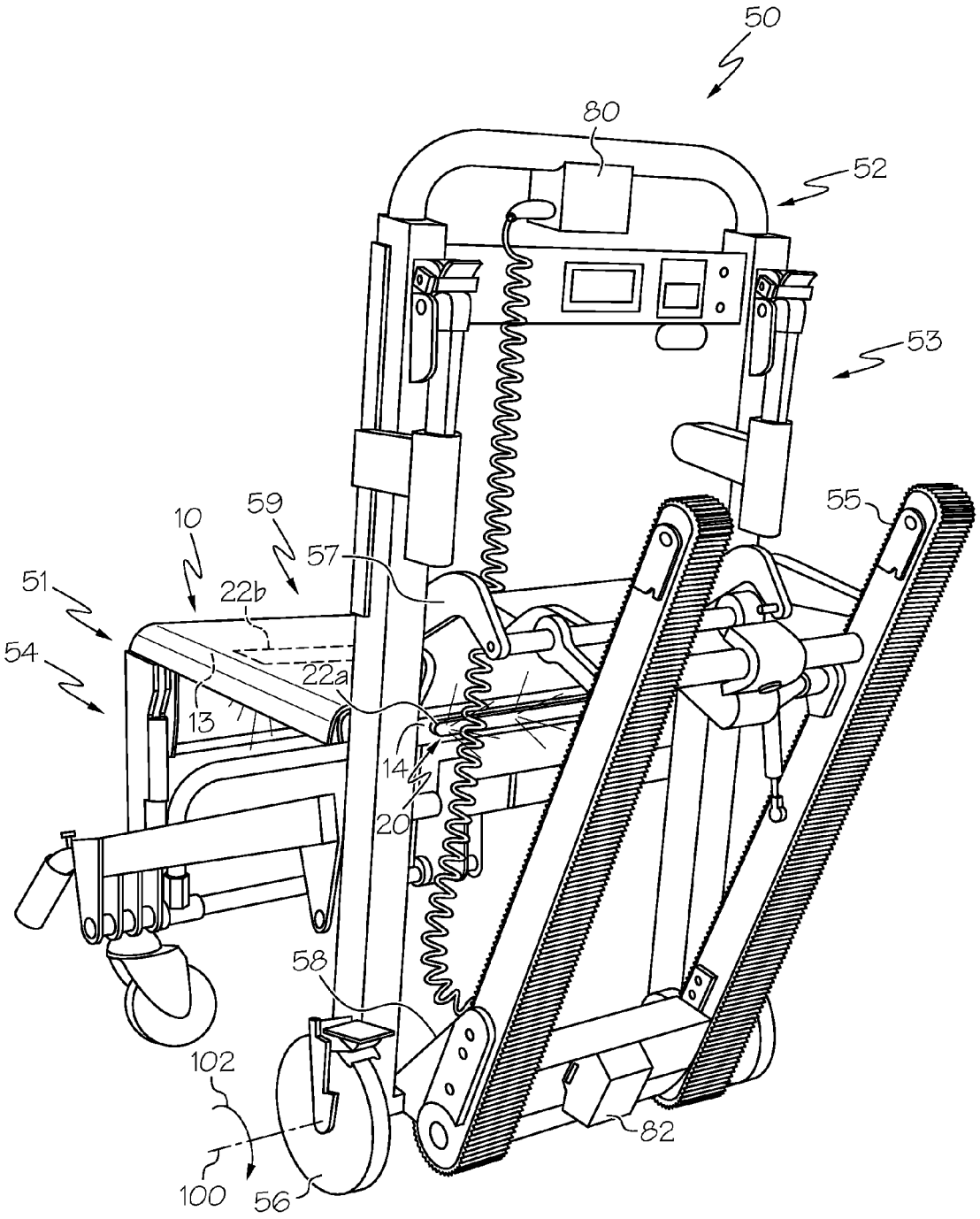
FIG. 8 schematically depicts a rear perspective view of the seat assembly of FIG. 1 attached to a patient transport device according to one or more embodiments described herein.
Figure 9:
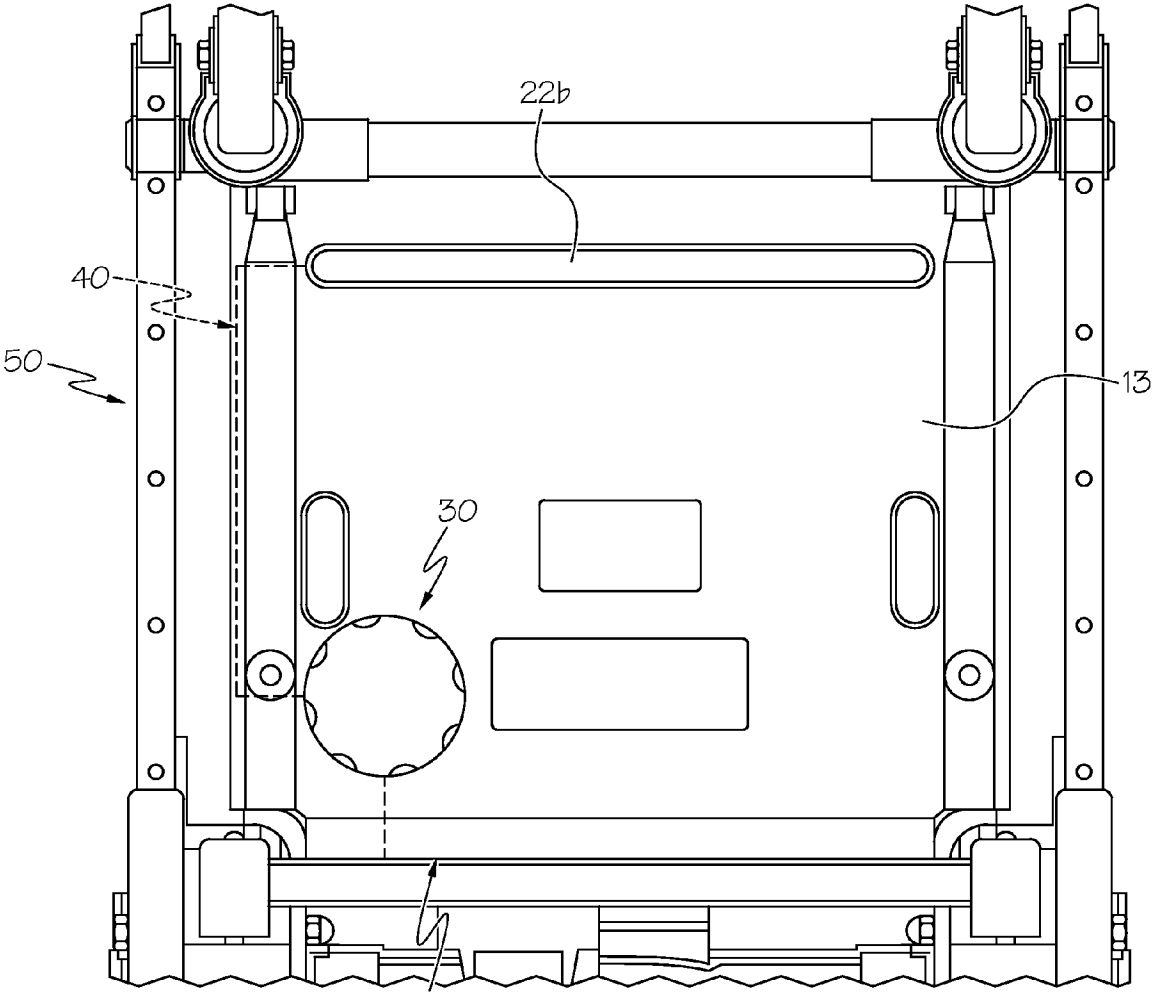
FIG. 9 schematically depicts a bottom view of the seat assembly of FIG. 1 attached to the patient transport device of FIG. 8 according to one or more embodiments described herein.

Referring to FIGS. 8 and 9 collectively, a patient transport device 50 suitable for use with the seat assembly 10 is depicted. The seat assembly 10 may be used with various patient transport devices, such as the patient transport device described in commonly owned U.S. patent application Ser. No. 14/117,080, the disclosure of which is herein incorporated by reference. It is to be appreciated that in still other embodiments, the seat assembly 10 may be used with other type of stair chairs, in the same manner as described above, such as for example with any of the stair chairs disclosed by, e.g. U.S. Pat. No. 7,520,347, as well as with the EZ Glide® Stair Chair, and the Compact 2 Track Chair, both of which are commercially available from Ferno-Washington, Inc., and Utila Chair Models ALS 103 and ALS 300, commercially available from Utila, Germany. The disclosure of U.S. Pat. No. 7,520,347 is herein incorporated fully by reference.

As depicted, the patient transport device 50 is a stair chair with a track assembly 55. The track assembly 55 is pivotally coupled to the patient transport device 50 through latching assembly 57 that selectively moves the track assembly 55 between a deployed position and a stowed position. The track assembly 55 is also pivotally connected at lower ends, via a pair of brackets 58, to a patient transport frame 52 for pivotal movement between the deployed position and the stowed position. In the deployed position, as depicted in FIG. 8, the track assembly 55 is positioned to engage stairs and/or stair ledges (not depicted) to assist a first responder in transporting a patient up or down a stair case with the patient transport device 50. In embodiments, such as the embodiment depicted in FIG. 8, the track assembly 55 is powered such that a track of the track assembly 55 is driven. In other embodiments, the track assembly 55 is not powered, and the track of the track assembly 55 may rotate as a result of engagement with stairs and/or stair ledges.

The patient transport device 50 includes the patient transport frame 52 including a front portion 51 and a rear portion 53. The patient transport frame 52 includes a collapsible seating assembly 54 including a seat portion 59, and ground-contacting wheels 56. The seat portion 59 includes the seat assembly 10 which is severally coupled to the patient transport frame 52. The seat portion 59 is repositionable between a collapsed position and an extended position, as depicted in FIG. 8. In the extended position, the seat portion 59 accommodates a patient sitting on the seat assembly 10 of the seat portion 59.

As described above, the seat assembly 10 includes the rear light output 22*a* and the lower light output 22*b* which are coupled to the rear edge 14 and the bottom surface 13 of the seat assembly 10, respectively. As the rear light output 22*a* and the lower light output 22*b* are coupled to the rear edge 14 and the bottom surface 13 of the seat assembly 10, once the seat assembly 10 is attached to a patient transport device, such as the patient transport device 50, the rear light output 22*a* and the lower light output 22*b* are positioned to provide light beneath the patient transport device 50. In particular, to transport a patient up or down a stair case, the patient transport device 50 may be pivoted about axis 100 in direction 102, such that the track assembly 55 contacts and engages stairs and/or stair ledges. As the patient transport device 50 pivots about axis 100, the rear light output 22*a* and the lower light output 22*b* are positioned to provide lighting underneath the patient transport device 50 to assist the first responder using the patient transport device and identifying obstacles beneath the patient transport device 50.

Figure 10:
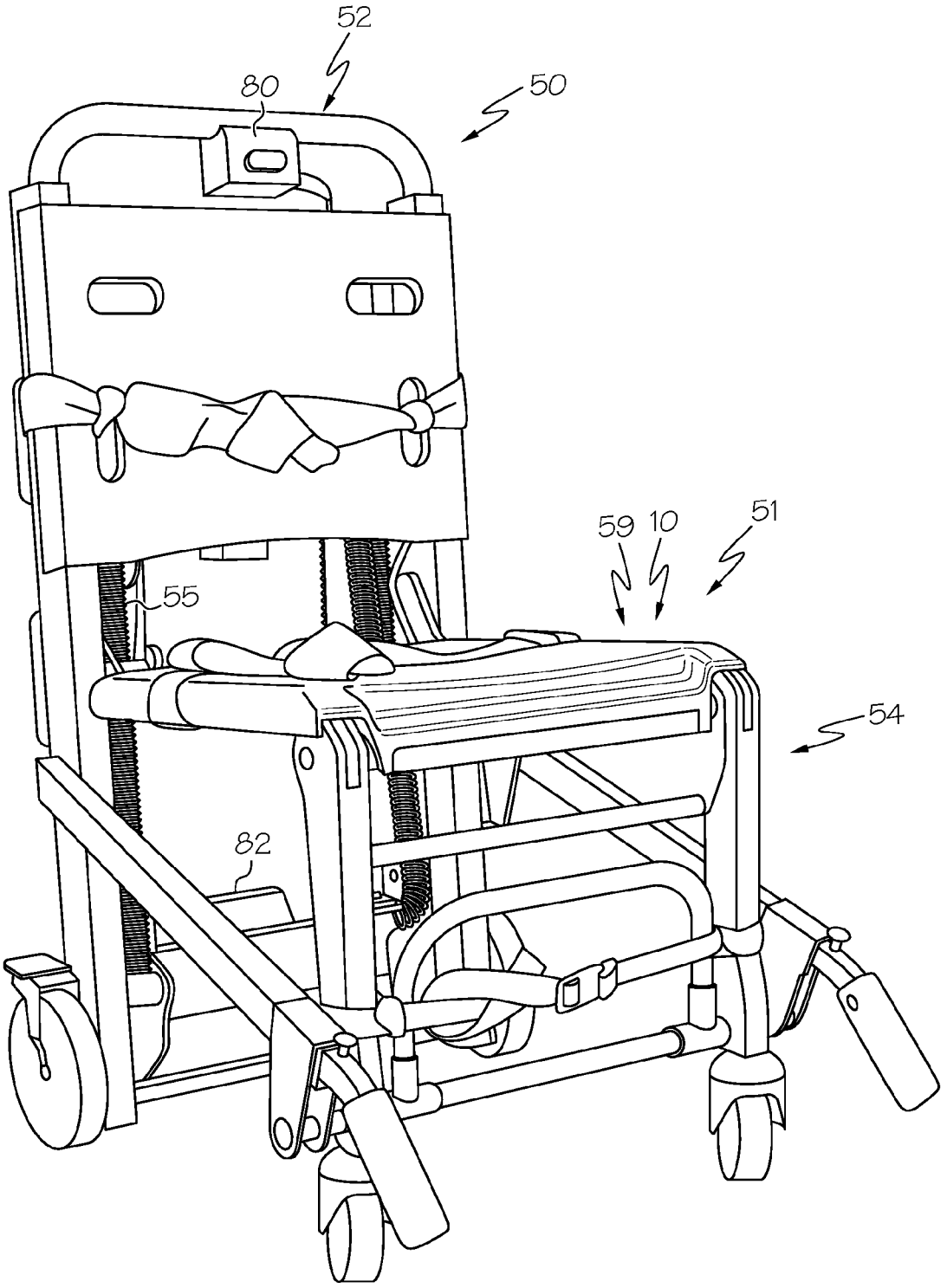
FIG. 10 schematically depicts a front perspective view of the patient transport device of FIG. 8 according to one or more embodiments described herein.

Referring to FIG. 10, the patient transport device 50 includes a user control 80. The user control 80 is communicatively coupled to the track assembly 55, and may be utilized to engage or disengage the track assembly 55. For example, a user, such as a first responder, may manipulate buttons and/or controls (not depicted) on the user control 80 to command the track of the track assembly 55 to rotate, which may assist the first responder in moving the patient transport device 50 up or down a set of stairs. The user control 80 may also be communicatively coupled to the rear light output 22*a* and the lower light output 22*b* (FIG. 8), and may be utilized to engage or disengage the rear light output 22*a* and the lower light output 22*b*, selectively turning the rear light output 22*a* and the lower light output 22*b* on and off.

The patient transport device 50 further includes a battery pack 82 that is electrically coupled to and provides electrical power to the track assembly 55. In some embodiments, the battery pack 82 may additionally be electrically coupled to the seat assembly 10 and may provide electrical power to the rear light output 22*a* and the lower light output 22*b*, alternative to or in addition to the batteries 35 (FIG. 7) of the housing 30.

Figure 11:
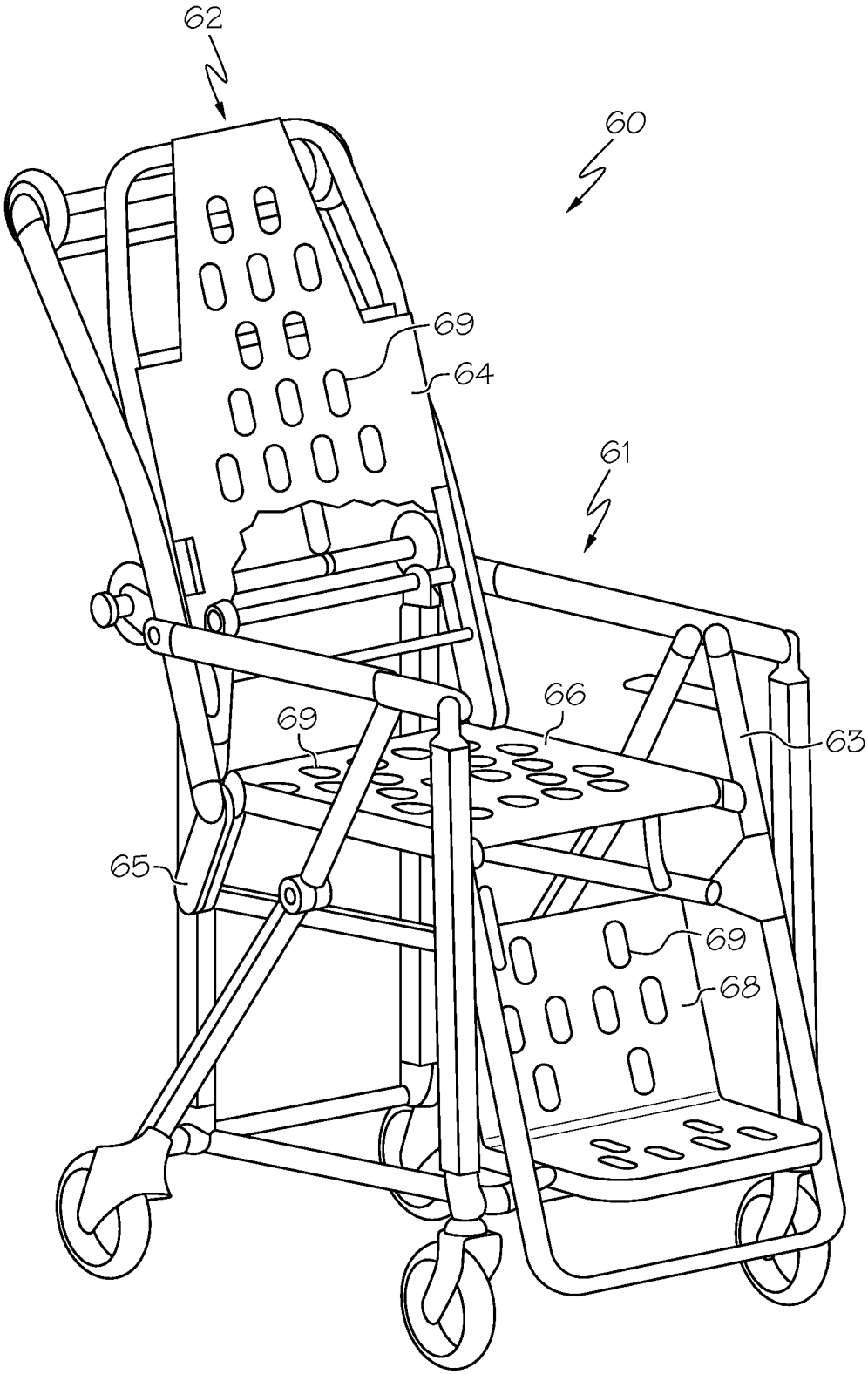
FIG. 11 schematically depicts a front perspective view of a patient transport device for use with the seat assembly of FIG. 1 according to one or more embodiments described herein.

Referring to FIG. 11, another example of a patient transport device 60 suitable for use with the seat assembly 10 is depicted. As depicted, the patient transport device 60 is a combination ambulance cot and chair, and which patient transport device 60 is more fully disclosed by commonly owned U.S. Pat. No. 8,104,121, the disclosure of which is herein incorporated fully by reference. The combination ambulance cot and patient transport device 60 includes a patient transport frame 61 including a segmented patient support 62, which is repositionable between a collapsed position and an extended position. In the extended position, the segmented patient support 62 may further be repositionable between a chair position, such as shown in FIG. 11, and a fully-reclined cot position (not shown). The segmented patient support 62 includes three main segments namely, a back portion 64, a seat portion 66, and a leg portion 68. Each of the back portion 64, the seat portion 66, and the leg portion 68 of the segmented patient support 62 include a plurality of holes 69 formed thereon. A front end of the seat portion 66 is attached to a lower frame member 63 and a rear end of the seat portion 66 is attached to pair of brackets 65.

In the embodiment shown in FIG. 11, the seat assembly 10 may be used in place of or in conjunction with the seat portion 66 of the combination ambulance cot and patient transport device 60. The rear edge 14, the front edge 16, the left side edge 18, and the right side edge 19 of the seat casing 12 may be attached to the lower frame member 63 and between the pair of brackets 65. Similar to the embodiment described above and depicted in FIGS. 8-10, the rear light output 22*a* and the lower light output 22*b* may provide lighting underneath the patient transport device 60 to assist the first responder using the patient transport device and identifying obstacles beneath the patient transport device 60. While the patient transport devices 50, 60 are described and depicted as a stair chair and a combination ambulance cot, it should be understood that in some embodiments, the seat assembly 10 may be utilized with other patient transport devices, including a wheel chair, a transport cot, or the like.

Figure 12:
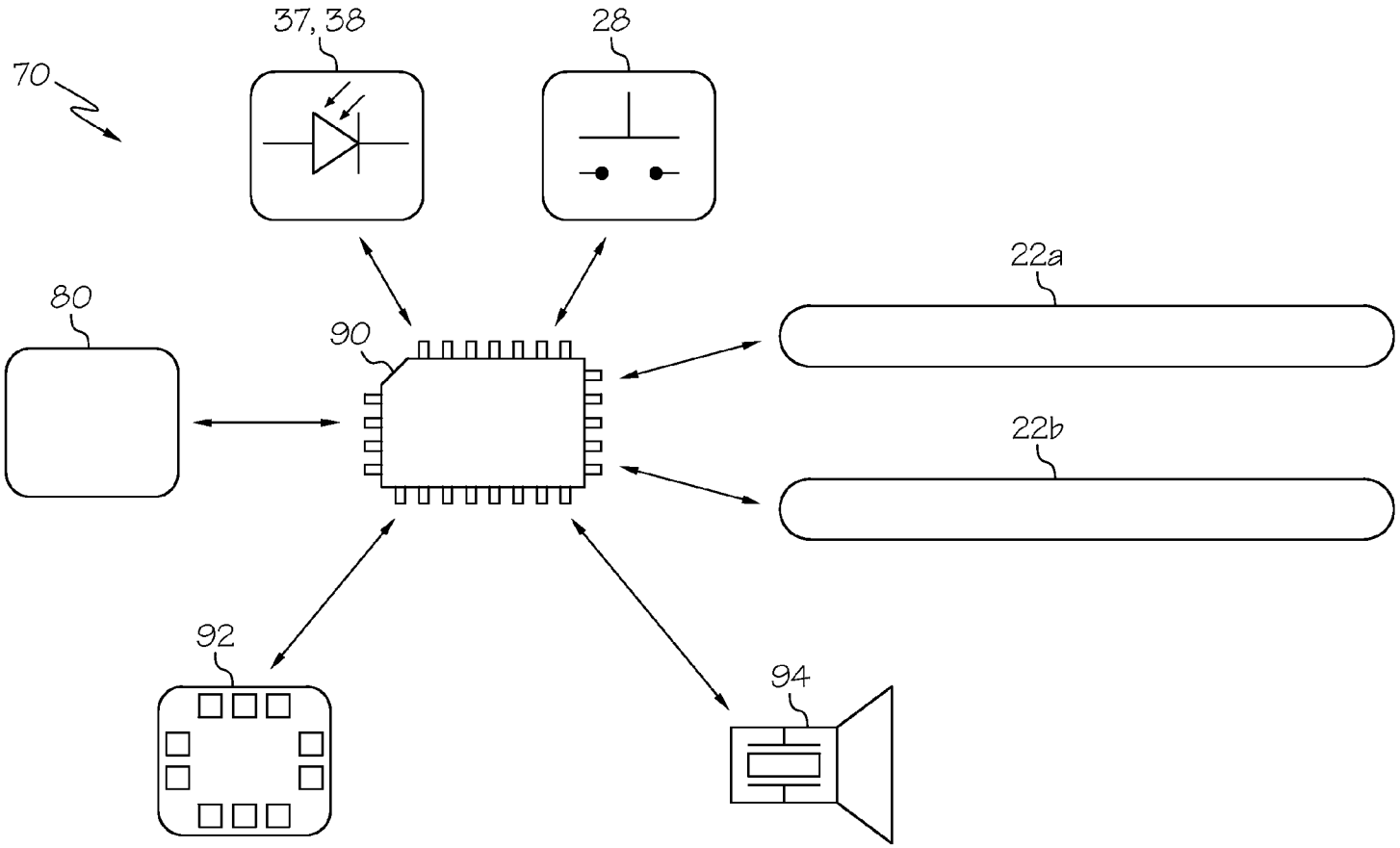
FIG. 12 schematically depicts a lighting unit according to one or more embodiments described herein.

Referring now to FIG. 12, the lighting unit 70 includes one or more controllers 90 that are communicatively coupled to the rear light output 22*a*, the lower light output 22*b*, the manual input 28, the user control 80, the illumination panel activation sensor 37, and/or the housing activation sensor 38. The controllers 90 include a processor and a memory storing a machine readable and executable instruction set, which when executed by the controller 90 facilitates operation of the lighting unit 70.

It is noted that the term "processor" generally means a device that executes functions according to machine readable instructions such as, for example, an integrated circuit, a microchip, a computer, a central processing unit, a graphics processing unit, field-programmable gate array (FPGA), an application-specific integrated circuit (ASIC), or any other computation device. The machine readable instructions can be stored in memory communicatively coupled to the processor. The term "memory," as used herein, generally means one or more apparatus capable of storing data or machine readable instructions for later retrieval such as, but not limited to, RAM, ROM, flash memory, hard drives, or combinations thereof.

The machine readable instructions described herein may comprise logic or algorithms written in any programming language of any generation (e.g., 1GL, 2GL, 3GL, 4GL, or 5GL) such as, e.g., machine language that may be directly executed by the processor, or assembly language, object-oriented programming (OOP), scripting languages, microcode, etc., that may be compiled or assembled into machine readable instructions and stored on a machine readable medium. Alternatively, the logic or algorithm may be written in a hardware description language (HDL), such as implemented via either an FPGA configuration or an ASIC, or their equivalents. according to one or more embodiments described herein that depicts the electrical connections between the various electrical components of the seat assembly 10 and the operational logic and features provided thereby.

The controllers 90 command the lighting unit 70 to change between an ON position and an OFF position according to one or more operating element or sensor such as, for example, the manual input 28 attached to the base 24 of the illumination panel 20. In some embodiments, the manual input 28 is communicatively coupled to the one or more controllers 90 (generally indicated in FIG. 12 by arrowed lines). In embodiments including a patient transport device 50 including a user control 80, the user control 80 is communicatively coupled to the one or more controllers 90. Accordingly, the manual input 28 and/or the user control 80 can enable control of the functions of the lighting unit 70. For example, a user can manually actuate the manual input 28 and/or the user control 80 to activate the lighting unit 70 to the ON position and alternatively, deactivating the lighting unit 70 by pressing the manual input 28 and/or user control 80 to an OFF position.

The rear light output 22*a*, the lower light output 22*b*, or both are communicatively coupled to the one or more controllers 90. Accordingly, the rear light output 22*a*, the lower light output 22*b*, or both can be selectively activated by functions executed by the one or more controllers 90. In particular, the rear light output 22*a* and/or the lower light output 22*b* are engaged and illuminated when the lighting unit 70 is in the ON position, and the rear light output 22*a* and/or the lower light output 22*b* are disengaged and not illuminated when the lighting unit 70 is in the OFF position.

In some embodiments, power can be provided to the lighting unit 70 via the batteries 35 (FIG. 7) and/or the battery pack 82 (FIG. 8). In embodiments that include the batteries 35, once the batteries 35 have been inserted into the battery holder 36 and the shell 34 is attached to the platform 32 to encase the battery holder 36, an alert or signal may be provided to the user that the lighting unit 70 is in the ON position via an acoustic transducer 94 that can be communicatively coupled to the one or more controllers 90. The acoustic transducer 94 may include an electromechanical element configured to convert electrical energy into mechanical energy such as, but not limited to, a speaker. Accordingly, the one or more controllers 90 can cause the acoustic transducer 94 to emit an alert or signal. The alert may comprise a short beeping sound.

In some embodiments, the alert of the acoustic transducer 94 can be contemporaneous with blinking or flashing of light by the rear light output 22*a* attached to the base 24 of the illumination panel 20 and the lower light output 22*b* attached to the bottom surface 13 of the seat casing 12. The combined alert of the lighting unit 70 can be utilized to indicate that the lighting unit is in operation and in the ON position. Once the lighting unit 70 is in operation and in the ON position, the lighting unit 70 can be automatically set to an IDLE mode or a RUN mode depending on the position of the seat assembly 10.

The lighting unit 70 is capable of operating in at least three modes. Specifically, a RUN mode, an IDLE mode and a DEEP SLEEP mode. Each mode will be described separately in conjunction with the apparatus and method of using the seat assembly 10 according to the embodiments described in FIGS. 1-11. When in the RUN mode, the lighting unit 70 can be automatically switched to an ON or OFF position based upon the position of the seat assembly 10. In some embodiments, the lighting unit 70 can comprise a position sensor 92 coupled to the seat casing 12 of the seat assembly 10 and/or the patient transport frame 52, 61 patient transport device 50, 60 for detecting the position of the seat assembly 10. The one or more positional sensors 92 can comprise any type of sensor that can be utilized to provide information indicative of the relative positioning of components of the seat assembly 10 such as, for example, accelerometer, inclinometer, proximity sensor, encoder, hall effect sensor, or the like. The one or more positional sensors 92 can be communicatively coupled to the one or more controllers 90.

The lighting unit 70 can automatically be changed to the ON position when the patient transport frame 52, 61 moves at least partially from the collapsed position toward the extended position. The one or more positional sensors 92 that are communicatively coupled to the one or more controllers 90 can be provided on the patient transport devices 50, 60 and/or the seat assembly 10 to detect information indicative of either the collapsed position or the extended position of the patient transport device 50, 60 and send a signal to the one or more controllers 90. For example, the lighting unit 70 can be automatically switched to the ON position when the positional sensors 92 detect that the seat assembly 10 and seat portion 59 according to the patient transport device 50 is in an extended or unfolded position, as shown in FIG. 8. Similarly, the lighting unit 70 can be automatically switched to the ON position when the positional sensors 92 detect that the seat portion 66 and the seat assembly 10, according to the combination ambulance cot and patient transport device 60, is in the extended and chair position, as shown in FIG. 11. Similarly, the lighting unit 70 can be automatically switched to the ON position when the positional sensors 92 the back portion 64, the seat portion 66 and seat assembly 10, and a leg portion 68 of the combination ambulance cot and patient transport device 60 in the extended and fully-reclined cot position. In the event that the positional sensors 92 detect that the seat assembly 10 is tilted at an angle with respect to a horizontal plane (i.e., with respect to the X-Y plane depicted by the X and Y axis in FIG. 1) that is greater than a predetermined angle, the lighting unit 70 can be automatically switched to the OFF position. In embodiments, the predetermined angle is 75°. Alternatively, the predetermined angle may be greater than 60° and less than 80°. In still other embodiments, the predetermined angle is greater than 45° and less than 90°. The lighting unit 70 can automatically switch to the OFF position when the seat assembly 10 connected to the patient transport device 50,60 is folded to a collapsible position to allow compact storage of the patient transport device 50,60.

Alternatively or additionally, the lighting unit 70 can be configured to automatically switch from the ON position to the OFF position described above when the illumination panel activation sensor 37 and/or the housing activation sensor 38 detects a light level above a predetermined light threshold (e.g., when the sensor is exposed to light) and send a signal to the one or more controllers 90. When the lighting unit 70 is in the RUN mode, the power consumption can be at a relatively high level depending on the type of illumination device utilized to from the being used, i.e., the current draw for illuminating the rear light output 22*a* and the lower light output 22*b* can be a substantial proportion of the current draw of the lighting unit. Accordingly, by switching the lighting unit 70 to the OFF position based on signals from the one or more positional sensors 92 and/or the illumination panel activation sensor 37 and the housing activation sensor 38, the power utilized by the seat assembly 10 may be minimized when the patient transport device 50, 60 is not in use or when lighting conditions render the illumination of the rear light output 22*a* and the lower light output 22*b* unnecessary.

Regarding the IDLE mode, the lighting unit 70 can be activated to the ON position, with the exception that the rear light output 22*a* and the lower light output 22*b* which are automatically switched to an OFF position to reduce the power consumption of the lighting unit 70. Thus the power consumption of the lighting unit 70 can be at an intermediate level (e.g., a current draw of about 4 mA).

Regarding the DEEP SLEEP mode, both the lighting unit 70 including the rear light output 22*a* and the lower light output 22*b* are automatically switched to the OFF position but remain in an operational state. The power consumption of the lighting unit 70 in the DEEP SLEEP mode can be at a relatively low level (e.g., a current draw of about 700 uA).

When the lighting unit 70 is in the RUN mode, the lighting unit 70 is capable of entering the IDLE mode or DEEP SLEEP mode. The IDLE mode may automatically be entered after about 5 minutes of inactivity of the seat assembly 10, which can be detected via the one or more positional sensors 92. The DEEP SLEEP mode may automatically be entered by the user via actively pushing the manual input 28 for about 4 seconds. A signal can be provided by the acoustic transducer 94 once the user activates the DEEP SLEEP mode, such a signal can include a long descending tone or melody.

When the lighting unit 70 is in the IDLE mode, the lighting unit 70 is capable of entering the RUN mode or the DEEP SLEEP mode. The RUN mode can be activated by one or more methods. For example, user activation via the manual input 28 can activate the RUN mode. Once the manual input 28 is activated a short beeping sound is given to alert or signal the user that the rear light output 22*a* and the lower light output 22*b* have been activated or switched from the OFF position to the ON position. Alternatively or additionally, movement or shaking of the seat assembly 10 can activate the RUN mode. Specifically, the one or more positional sensors 92 can detect movement of the seat assembly 10, such as movement of or deployment of the patient transport device 50, 60. Thus, the lighting unit 70 can be automatically activated or switched from the OFF position to the ON position.

With respect to the DEEP SLEEP mode, the lighting unit 70 may automatically switch from the IDLE mode into the DEEP SLEEP mode after about 25 minutes of inactivity of the seat assembly 10, which can be detected by the one or more positional sensors 92. Once the switch is automatically made from the IDLE mode to the DEEP SLEEP mode an alert or signal can be provided. The alert or signal may be three long descending tones or melodies.

When the lighting unit 70 is in the DEEP SLEEP mode, the lighting unit 70 can be configured such that the RUN mode can only be reactivated by actuation of the manual input 28. Once the manual input 28 has been actuated to reactivate the lighting unit 70 into the RUN mode, an alert or signal can be provided to indicate that the lighting unit 70 has entered the RUN mode. The alert or signal may be two short ascending tones or melodies.

It should now be understood that seat assemblies according to the present disclosure include a lighting unit that includes a light output that is coupled to at least one of a bottom surface of the seat assembly or a rear edge outward-facing surface of the seat assembly. In one embodiment, the lighting unit includes a controller that is communicatively coupled to the light output, where the controller facilitates operation of the lighting unit. In other embodiments, the seat assembly is severally coupled to a patient transport device that includes a track assembly that may assist a first responder in moving the patient transport device up and down stairs. By including a lighting unit that includes a light output that is coupled to at least one of the bottom surface of the seat assembly or the rear edge outward-facing surface of the seat assembly, the lighting unit may provide light beneath a patient transport device, assisting first responders in identifying obstacles while moving patients to and from an emergency service vehicle. Further, by utilizing a controller to facilitate operation of the lighting unit, the lighting unit may conserve power when not in use or when additional lighting is unnecessary.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A patient transport device comprising:

a patient transport frame;

a seat portion that is repositionable between a collapsed position and an extended position, the seat portion comprising:

a seat casing comprising a bottom surface, a rear edge comprising a rear edge outward-facing surface, wherein the rear edge outward-facing surface extends downward from the bottom surface in a vertical direction;

a sensor coupled to at least one of the seat casing or the patient transport frame;

a light output coupled to at least one of the bottom surface or the rear edge outward-facing surface of the seat casing, wherein the light output is communicatively coupled and responsive to the sensor, such that the light output changes between an ON position in which the light output is illuminated and an OFF position in which the light output is not illuminated based on a signal from the sensor.

2. The patient transport device of claim 1, wherein the sensor is a position sensor communicatively coupled to the light output, wherein the light output changes to the ON position when the position sensor detects the patient transport frame moves at least partially from the collapsed position toward the extended position.

3. The patient transport device of claim 1, wherein the sensor is an activation sensor communicatively coupled to the light output, wherein the light output changes to the OFF position when the activation sensor detects a light level above a predetermined light threshold.

4. The patient transport device of claim 3, further comprising a housing coupled to the bottom surface of the seat casing, wherein the activation sensor is positioned within the housing.

5. The patient transport device of claim 3, further comprising an illumination panel coupled to the rear edge outward-facing surface of the seat casing, wherein the activation sensor is positioned within the illumination panel.

6. The patient transport device of claim 1, wherein the light output is a lower light output that is coupled to the bottom surface of the seat casing.

7. The patient transport device of claim 1, wherein the light output is a rear light output that is coupled to the rear edge outward-facing surface of the seat casing.

8. The patient transport device of claim 1, wherein the light output is a rear light output that is attached to an illumination panel comprising a base that is mounted to the rear edge outward-facing surface of the seat casing.

* * * * *